US005297567A

United States Patent [19]

Summerville et al.

[11] Patent Number: 5,297,567

[45] Date of Patent: Mar. 29, 1994

[54] HAIR CURLING ROLLER APPARATUS

[76] Inventors: Melanie L. Summerville, 998 Monaca Rd.; Daniel W. Gillin, 102 Gillin Dr., both of Monaca, Pa. 15061

[21] Appl. No.: 99,653

[22] Filed: Jul. 30, 1993

[51] Int. Cl.[5] ..... A45D 1/02

[52] U.S. Cl. ..... 132/227; 132/229; 132/248

[58] Field of Search ..... 132/212, 220, 223, 227, 132/228, 248, 250, 253, 254, 255, 256, 333

[56] References Cited

U.S. PATENT DOCUMENTS

| | | | |
|---|---|---|---|
| 3,541,302 | 11/1970 | Makino | 132/229 |
| 3,585,357 | 6/1971 | Mandell et al. | 132/229 |
| 3,654,428 | 4/1972 | Talge et al. | 132/229 |
| 3,696,819 | 10/1972 | Jensen | 132/233 |
| 4,538,630 | 9/1985 | Henderson | 132/229 |
| 4,834,118 | 5/1989 | Goeller | 132/246 |
| 4,958,648 | 9/1990 | Morey | 132/229 |
| 5,025,816 | 6/1991 | Jones | 132/246 |

FOREIGN PATENT DOCUMENTS

| | | | |
|---|---|---|---|
| 1299102 | 7/1969 | Fed. Rep. of Germany | 132/333 |
| 0033754 | 3/1978 | Japan | 132/227 |

*Primary Examiner*—Gene Mancene
*Assistant Examiner*—Frank A. LaViola
*Attorney, Agent, or Firm*—Leon Gilden

[57] ABSTRACT

A housing is provided having a plurality of stepped top walls, each including an annular array of hair curling receiving sockets, with each of the hair curlers having a heat retentive silicon gel contained therewithin to retain thermal heating thereof.

2 Claims, 4 Drawing Sheets

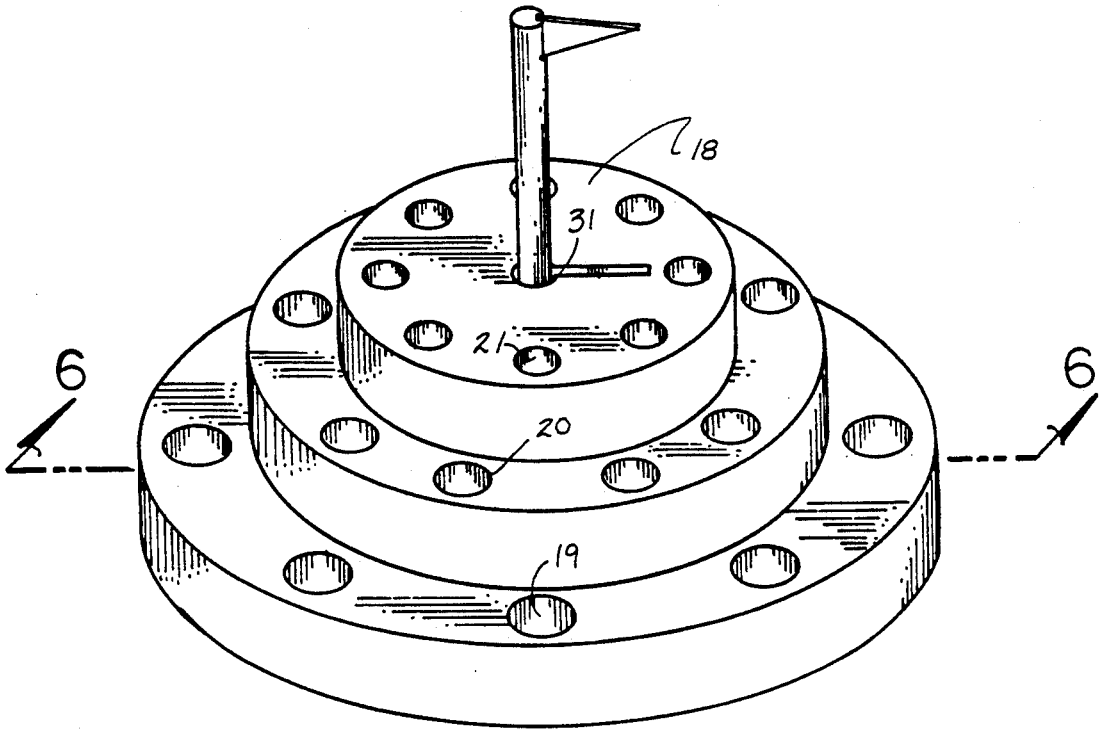
FIG. 5
FIG. 6
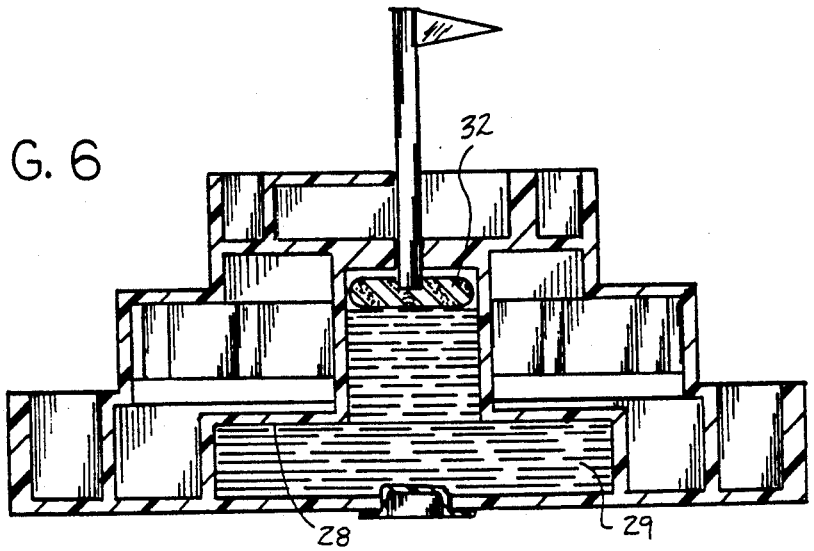

HAIR CURLING ROLLER APPARATUS

BACKGROUND OF THE INVENTION

1. Field of the Invention

The field of invention relates to hair curling apparatus, and more particularly pertains to a new and improved hair curling roller apparatus wherein the same is arranged for the positioning of hair curlers about a housing permitting their subsequent heating.

2. Description of the Prior Art

Hair curlers of various types are available in the prior art. Such structure is indicated in the U.S. Pat. Nos. 3,913,492; 4,572,221; 3,696,819; and 4,958,648.

The instant invention attempts to overcome deficiencies of the prior art by providing for hair curling structure arranged and mounted in an array relative to other such hair curlers for ease of orientation to obtain heat during a heating procedure and in this respect, the present invention substantially fulfills this need.

SUMMARY OF THE INVENTION

In view of the foregoing disadvantages inherent in the known types of hair curling apparatus now present in the prior art, the present invention provides a hair curling roller apparatus wherein the same includes a housing mounting a plurality of annular arrays of hair curlers for convenience of heating. As such, the general purpose of the present invention, which will be described subsequently in greater detail, is to provide a new and improved hair curling roller apparatus which has all the advantages of the prior art hair curling apparatus and none of the disadvantages.

To attain this, the present invention provides a housing having a plurality of stepped top walls, each including an annular array of hair curling receiving sockets, with each of the hair curlers having a heat retentive silicon gel contained therewithin to retain thermal heating thereof.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hair curling roller apparatus which has all the advantages of the prior art hair curling apparatus and none of the disadvantages.

It is another object of the present invention to provide a new and improved hair curling roller apparatus which may be easily and efficiently manufactured and marketed.

It is a further object of the present invention to provide a new and improved hair curling roller apparatus which is of a durable and reliable construction.

An even further object of the present invention is to provide a new and improved hair curling roller apparatus which is susceptible of a low cost of manufacture with regard to both materials and labor, and which accordingly is then susceptible of low prices of sale to the consuming public, thereby making such hair curling roller apparatus economically available to the buying public.

Still yet another object of the present invention is to provide a new and improved hair curling roller apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric illustration of a modified housing structure of the invention.

FIG. 6 is an orthographic view, taken along the lines 6—6 of FIG. 5 in the direction indicated by the arrows.

DESCRIPTION OF THE PREFERRED EMBODIMENT

Figure 1:
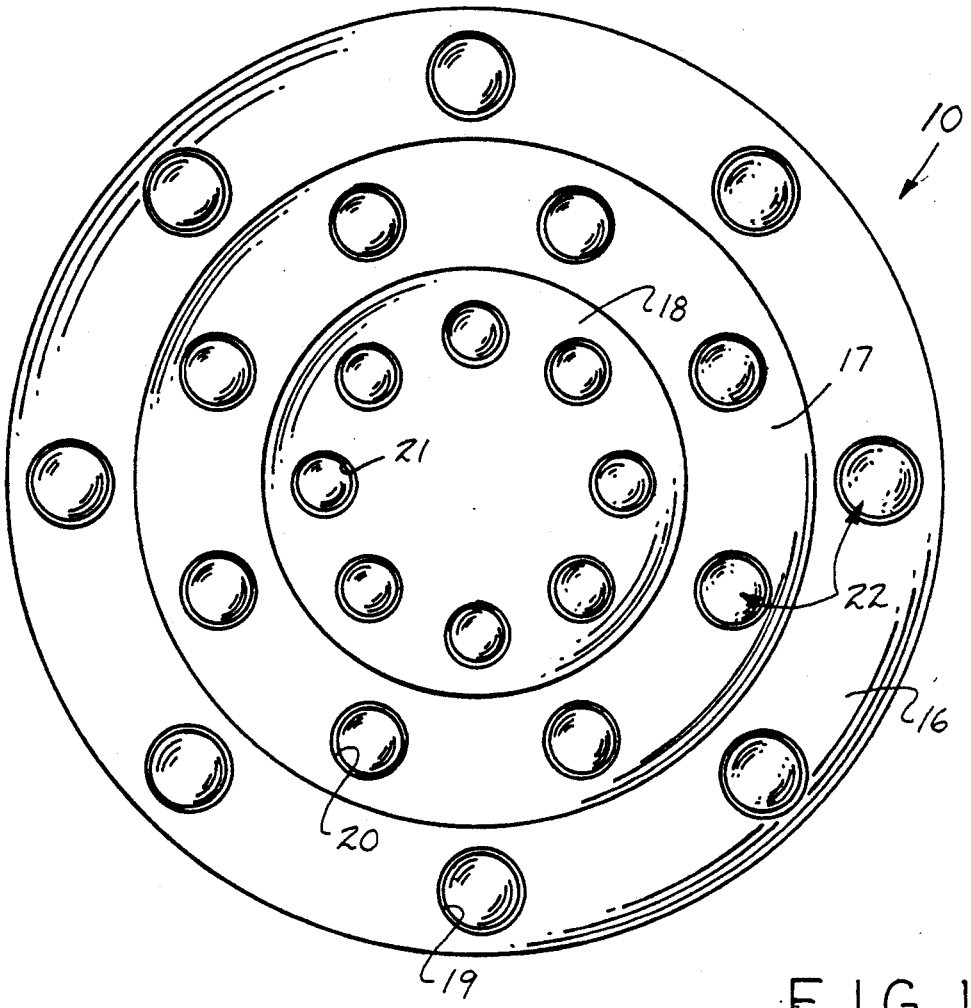
FIG. 1 is an orthographic top view of the invention.
Figure 2:
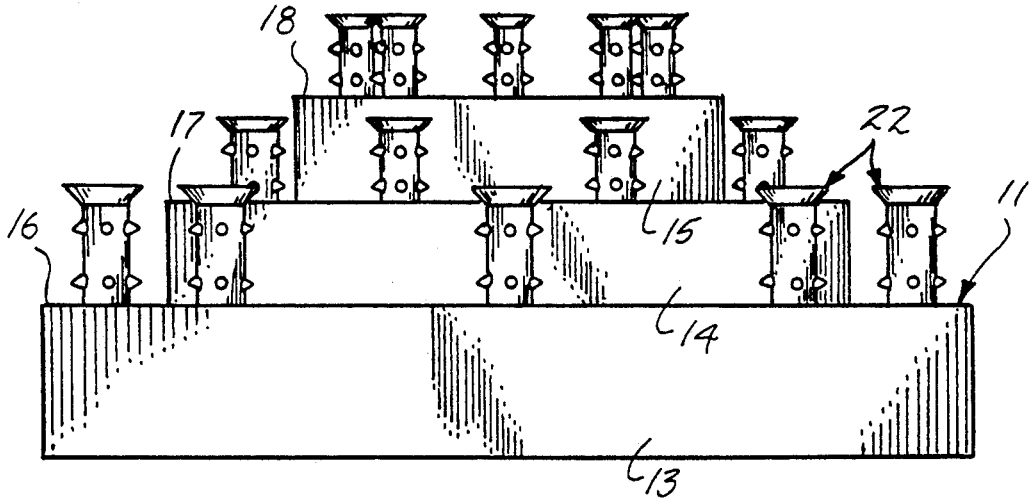
FIG. 2 is an orthographic side view of the invention.
Figure 3:
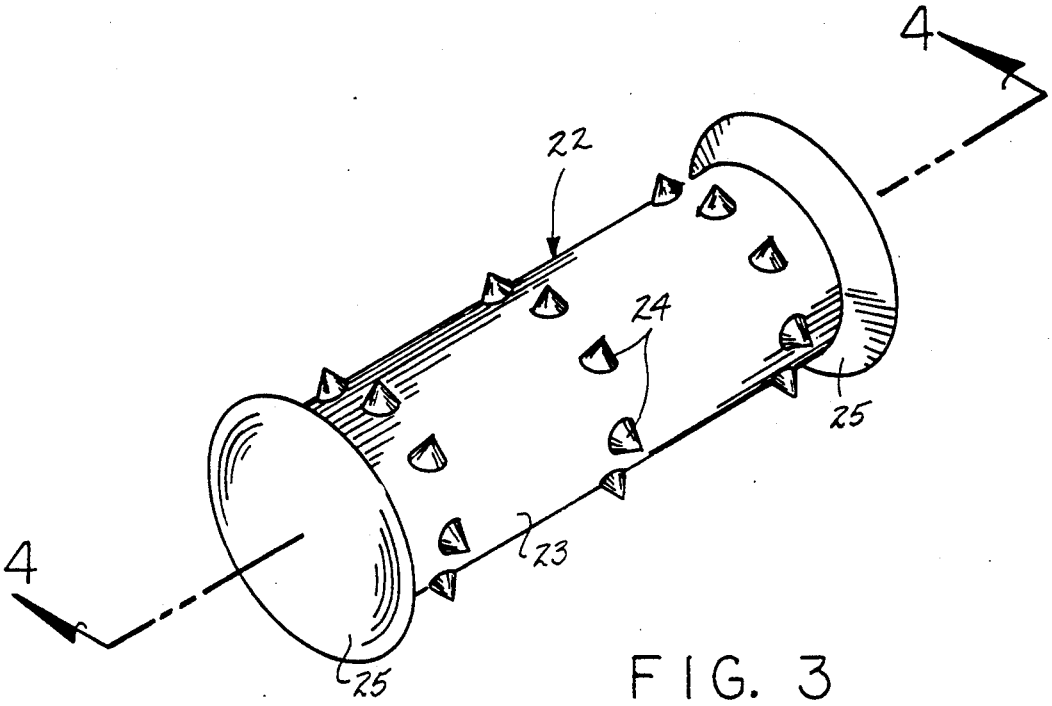
FIG. 3 is an isometric illustration of a hair curler of the invention.
Figure 4:
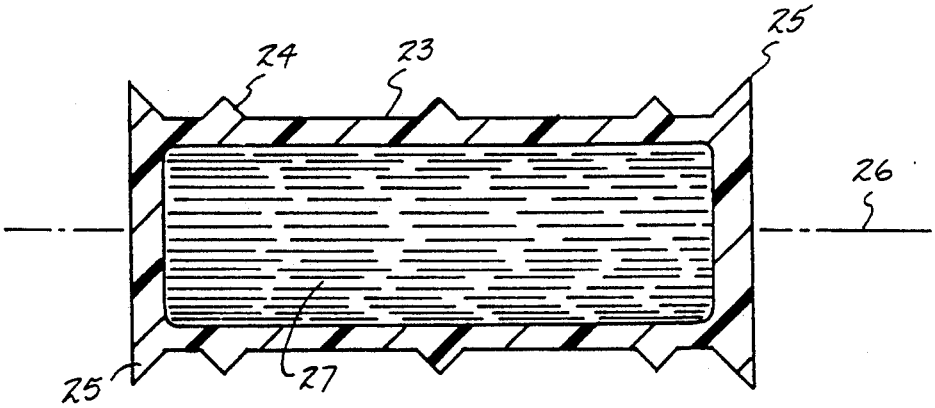
FIG. 4 is an orthographic view, taken along the lines 4—4 of FIG. 3 in the direction indicated by the arrows.

With reference now to the drawings, and in particular to FIGS. 1 to 8 thereof, a new and improved hair curling roller apparatus embodying the principles and concepts of the present invention and generally designated by the reference numeral 10 will be described.

More specifically, the hair curling roller apparatus 10 of the instant invention essentially comprises a housing 11, having concentric annular side walls in a stepped spaced and parallel relationship, to include a first side wall 13 of a first diameter, a second side wall 14 of a second diameter less than said first diameter, and a third annular side wall 15 of a third diameter less than said first diameter. A first top wall 16 is oriented at an intersection of the first and second side walls parallel to a second top wall 17 at an intersection of the second and third side walls, with the third side wall terminating in a third top wall 18 positioned within the third side wall 15, as illustrated. Respective first, second, and third top walls 16, 17, and 18 includes respective first, second, and third annular arrays of hair curling receiving sockets 19, 20, and 21 respectively, each including a hair curling cylinder 22 therewithin. Each hair curling cylinder 22 includes a central cylinder 23 having end wall flanges 25 symmetrically oriented about an axis 26. A plurality of annular arrays of projections 24 extend from the central cylinder 23 to enhance engagement of hair in a curling procedure. A cavity within the central cylinder 23 includes a silicon gel 27 for heat retentive purposes. Optimally, the structure may be positioned within a microwave oven and the like for enhanced heating of the organization and more specifically, each of the hair curlers 22.

The FIG. 5 indicates the use of a modified housing, having a housing cavity 28 including expandable gel 29 therewithin, wherein a signal shaft 30 is reciprocatably received through a signal shaft opening 31 within the third top wall 18. The signal shaft 30 is mounted upon a float 32, that in turn is floatingly positioned upon the expandable gel 29, such that upon adequate heating the signal shaft projects through the third top wall 18, in a manner as indicated in FIG. 6, for indication of adequate heating of the structure.

Figure 7:
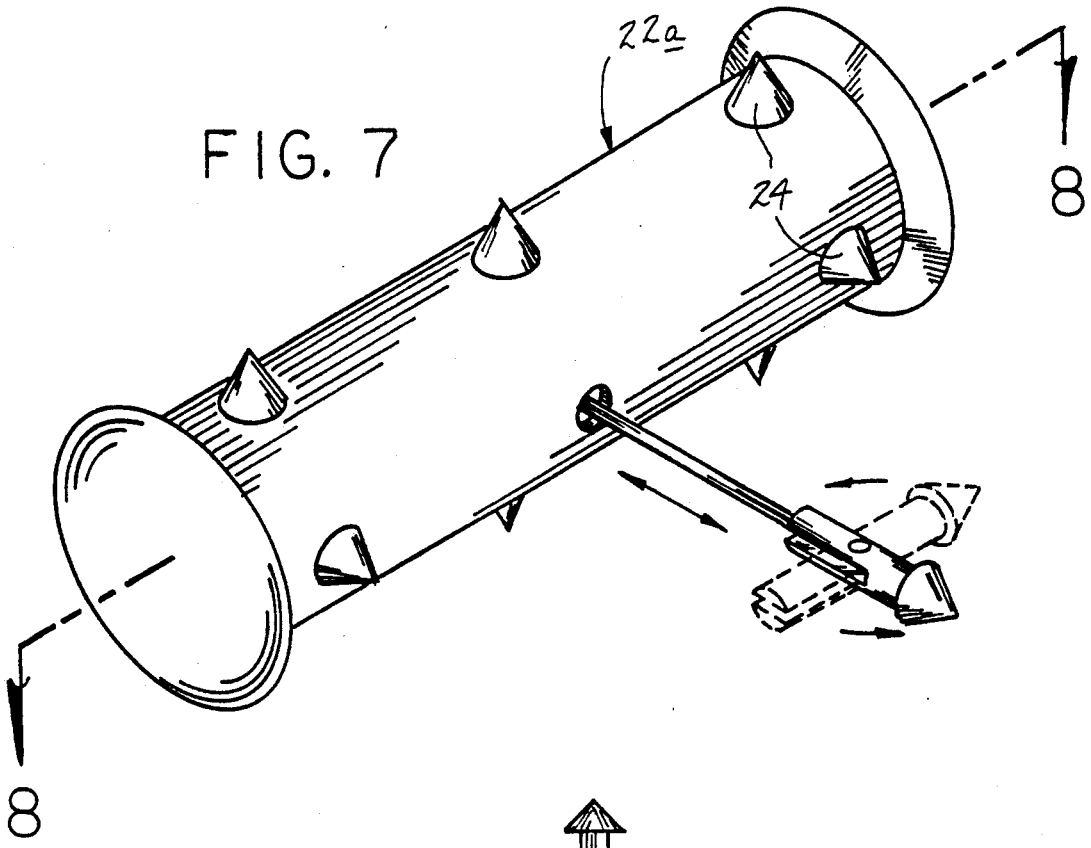
FIG. 7 is an isometric illustration of a modified hair roller structure.
Figure 8:
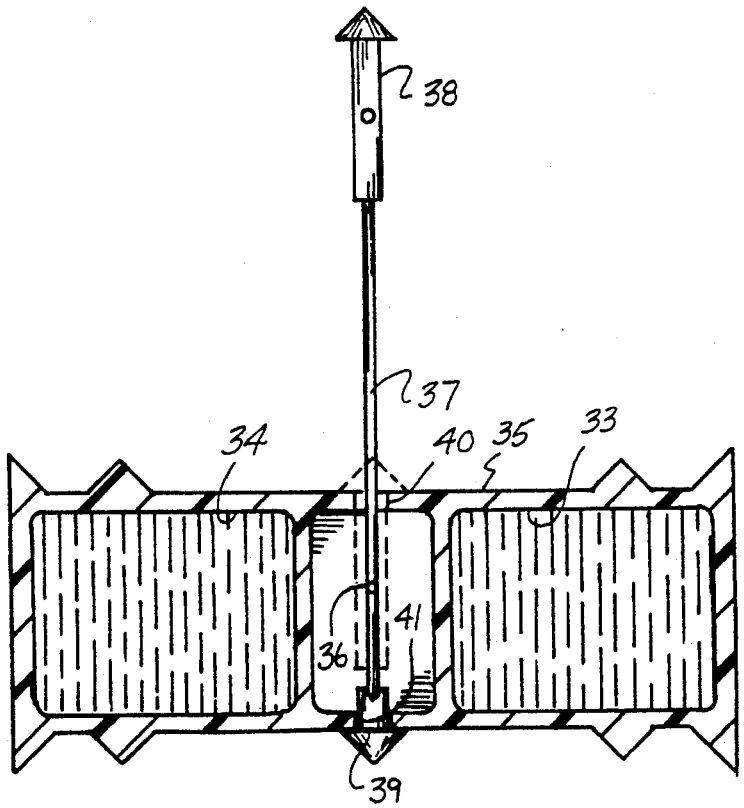
FIG. 8 is an orthographic view, taken along the lines 8—8 of FIG. 7 in the direction indicated by the arrows.

The FIG. 7 indicates the use of a modified hair curling cylinder **22*a*, having spaced first and second cylinder cavities 33 and 34 positioned against and adjacent one of the flanges 25, such that the first and second cylinders 33 and 34 include respective first and second quantities of the silicon gel therewithin. A central cavity 35 includes an anchor shaft 36 medially thereof fixedly secured to elastomeric cord 37 medially of the elastomeric cord, with a first anchor lug 38 mounted to a first end of the cord 37, and a second anchor lug 39 mounted to a second end of the elastomeric cord 37 for securement about hair portions, with the first anchor lug 38 received within the first opening 40 in communication with the central cavity diametrically aligned with a second opening 41 in communication with the central cavity 35**.

The first and second anchor lugs 38 and 39 are pivotally mounted relative to the elastomeric cord 37 to provide for ease of engagement to hair during the use of the hair curler cylinder **22*a***.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hair curling roller apparatus, comprising:

a housing having a plurality of concentric annular side walls, including a first side wall, a second side wall, and a third side wall, and arranged in a spaced concentric relationship, with a first top wall mounted to said first side wall, a second side wall mounted to the second side wall, and a third top wall mounted to the third side wall, with the first top wall, the second side wall and the third side wall each including an array of hair curling cylinder container receiving sockets, with each of said sockets having a hair curling cylindrical container therewith, each hair curling cylinder including a central cylinder and a plurality of end flanges, wherein the end flanges are orthogonally oriented relative to and axis of said cylinder, said cylinders having at least one first cylinder cavity containing a silicon gel therewithin, said gel having heat retentive properties, each cylinder including a second cavity spaced from said first cavity, and a central cavity intermediate the first and second cavity, the first cavity and the second cavity each including said silicon gel therewithin, the central cavity having an anchor shaft medially thereof, an elastomeric cord secured to said anchor shaft, with the elastomeric cord having a first end and a second end, the first end including a first anchor lug, the second end having a second anchor, with a first opening directed through said cylinder into said central cavity, and a second opening directed through said cylinder into said central cavity, the first anchor lug being received within the first opening and the second anchor lug being received within the second opening, wherein at least said first anchor lug is pivotally mounted to said elastomeric cord.

2. An apparatus as set forth in claim 1 wherein said housing includes a housing cavity, said housing cavity having a heat expandable gel contained therewithin, with a float mounted upon said gel, the float having a signal shaft, the signal shaft reciprocatably directed through said third top wall permitting projection of said signal shaft upon heating of said expandable gel.

* * * * *